US007194788B2

(12) United States Patent
Clark et al.

(10) Patent No.: US 7,194,788 B2
(45) Date of Patent: Mar. 27, 2007

(54) SOFT AND BULKY COMPOSITE FABRICS

(75) Inventors: James William Clark, Roswell, GA (US); Henry Skoog, Marietta, GA (US); James J. Detamore, Atlanta, GA (US); Shawn Eric Jenkins, Duluth, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 130 days.

(21) Appl. No.: 10/744,606

(22) Filed: Dec. 23, 2003

(65) Prior Publication Data

US 2005/0136776 A1 Jun. 23, 2005

(51) Int. Cl.
*D04H 5/02* (2006.01)

(52) U.S. Cl. ..... 28/104

(58) Field of Classification Search ..... 28/104, 28/105, 167, 103; 442/382, 384, 408, 387, 442/389; 156/148
See application file for complete search history.

(56) References Cited

U.S. PATENT DOCUMENTS

| | | | | |
|---|---|---|---|---|
| 1,301,605 | A | | 4/1919 | Ringel |
| 2,014,460 | A | | 9/1935 | Alm |
| 2,069,778 | A | | 2/1937 | Rowe |
| 2,666,369 | A | | 1/1954 | Niks |
| 3,338,992 | A | | 8/1967 | Kinney |
| 3,341,394 | A | | 9/1967 | Kinney |
| 3,485,706 | A | | 12/1969 | Evans |
| 3,494,821 | A | | 2/1970 | Evans |
| 3,502,538 | A | | 3/1970 | Peterson |
| 3,502,763 | A | | 3/1970 | Hartman |
| 3,542,615 | A | | 11/1970 | Dobo et al. |
| 3,597,299 | A | | 8/1971 | Thomas et al. |
| 3,692,618 | A | | 9/1972 | Dorschner et al. |
| 3,768,118 | A | * | 10/1973 | Ruffo et al. ..... 264/511 |
| 3,775,231 | A | | 11/1973 | Thomas |
| 3,802,817 | A | | 4/1974 | Matsuki et al. |
| 3,821,068 | A | | 6/1974 | Shaw |
| 3,844,869 | A | | 10/1974 | Rust, Jr. |
| 3,849,241 | A | | 11/1974 | Butin et al. |
| 3,855,046 | A | | 12/1974 | Hansen et al. |

(Continued)

FOREIGN PATENT DOCUMENTS

EP 0097036 A2 12/1983

(Continued)

OTHER PUBLICATIONS

Thomaschefsky, et al., U.S. Appl. No. 10/745,339, filed Dec. 23, 2003, Ultrasonically Laminated Multi-Ply Fabrics.

(Continued)

*Primary Examiner*—Amy B. Vanatta
(74) *Attorney, Agent, or Firm*—Dority & Manning, P.A.

(57) ABSTRACT

A composite fabric is provided that contains staple fibers hydraulically entangled with a nonwoven web formed from continuous filaments. A portion of the staple fibers is entangled with the web, while another portion protrudes through the web. The resulting surface topography has one surface with a preponderance of the smooth, staple fibers, and another surface with a preponderance of the continuous filaments from the nonwoven web, but also including some of the protruded smooth, staple fibers. Thus, each surface contains smooth staple fibers and is soft.

37 Claims, 3 Drawing Sheets

U.S. PATENT DOCUMENTS

| | | | | |
|---|---|---|---|---|
| 3,879,257 | A | | 4/1975 | Gentile et al. |
| 3,914,365 | A | | 10/1975 | Kim et al. |
| 3,939,033 | A | | 2/1976 | Grgach et al. |
| 3,949,128 | A | | 4/1976 | Ostermeier |
| 3,952,124 | A | * | 4/1976 | Mesek ..... 428/218 |
| 3,953,638 | A | | 4/1976 | Kemp |
| 4,100,324 | A | | 7/1978 | Anderson et al. |
| 4,107,374 | A | | 8/1978 | Kusunose et al. |
| 4,144,370 | A | | 3/1979 | Boulton |
| 4,145,468 | A | | 3/1979 | Mizoguchi et al. |
| 4,165,556 | A | | 8/1979 | Nishida et al. |
| 4,239,720 | A | | 12/1980 | Gerlach et al. |
| 4,259,399 | A | | 3/1981 | Hill |
| 4,307,143 | A | | 12/1981 | Meitner |
| 4,340,563 | A | | 7/1982 | Appel et al. |
| 4,365,466 | A | | 12/1982 | Horiuchi et al. |
| 4,369,156 | A | | 1/1983 | Mathes et al. |
| 4,374,888 | A | | 2/1983 | Bornslaeger |
| 4,460,699 | A | | 7/1984 | Convers et al. |
| 4,476,186 | A | | 10/1984 | Kato et al. |
| RE31,885 | E | | 5/1985 | Meitner |
| 4,519,804 | A | | 5/1985 | Kato et al. |
| 4,587,154 | A | | 5/1986 | Hotchkiss et al. |
| 4,612,228 | A | | 9/1986 | Kato et al. |
| 4,612,237 | A | * | 9/1986 | Frankenburg ..... 428/219 |
| 4,735,849 | A | | 4/1988 | Murakami et al. |
| 4,774,110 | A | | 9/1988 | Murakami et al. |
| 4,795,122 | A | | 1/1989 | Petre |
| 4,795,668 | A | | 1/1989 | Krueger et al. |
| 4,808,467 | A | | 2/1989 | Suskind et al. |
| 4,833,012 | A | | 5/1989 | Makimura et al. |
| 4,879,170 | A | | 11/1989 | Radwanski et al. |
| 4,931,355 | A | | 6/1990 | Radwanski et al. |
| 4,965,122 | A | | 10/1990 | Morman |
| 4,981,747 | A | | 1/1991 | Morman |
| 5,026,587 | A | | 6/1991 | Austin et al. |
| 5,057,368 | A | | 10/1991 | Largman et al. |
| 5,069,970 | A | | 12/1991 | Largman et al. |
| 5,096,532 | A | | 3/1992 | Neuwirth et al. |
| 5,108,820 | A | | 4/1992 | Kaneko et al. |
| 5,110,403 | A | | 5/1992 | Ehlert |
| 5,136,761 | A | | 8/1992 | Sternlieb et al. |
| 5,137,600 | A | | 8/1992 | Barnes et al. |
| 5,151,320 | A | * | 9/1992 | Homonoff et al. ..... 442/384 |
| 5,162,074 | A | | 11/1992 | Hills |
| 5,198,292 | A | | 3/1993 | Lerner et al. |
| 5,204,703 | A | | 4/1993 | Hutchinson et al. |
| 5,219,633 | A | | 6/1993 | Sabee |
| 5,223,319 | A | | 6/1993 | Cotton et al. |
| 5,226,992 | A | | 7/1993 | Morman |
| 5,254,399 | A | | 10/1993 | Oku et al. |
| 5,258,220 | A | | 11/1993 | Joseph |
| 5,277,976 | A | | 1/1994 | Hogle et al. |
| 5,281,463 | A | | 1/1994 | Cotton |
| 5,284,703 | A | | 2/1994 | Everhart et al. |
| 5,290,628 | A | | 3/1994 | Lim et al. |
| 5,298,315 | A | * | 3/1994 | Fukui et al. ..... 442/387 |
| 5,328,759 | A | * | 7/1994 | McCormack et al. ..... 442/402 |
| 5,336,545 | A | | 8/1994 | Morman |
| 5,336,552 | A | | 8/1994 | Strack et al. |
| 5,350,624 | A | | 9/1994 | Georger et al. |
| 5,355,565 | A | | 10/1994 | Baravian |
| 5,364,680 | A | | 11/1994 | Cotton |
| 5,366,793 | A | | 11/1994 | Fitts, Jr. et al. |
| 5,382,400 | A | | 1/1995 | Pike et al. |
| 5,389,202 | A | | 2/1995 | Everhart et al. |
| 5,393,599 | A | | 2/1995 | Quantrille et al. |
| 5,413,811 | A | | 5/1995 | Fitting et al. |
| 5,459,912 | A | * | 10/1995 | Oathout ..... 28/105 |
| 5,460,864 | A | | 10/1995 | Heitkamp |
| 5,466,410 | A | | 11/1995 | Hills |
| 5,498,232 | A | | 3/1996 | Scholz |
| 5,509,430 | A | | 4/1996 | Berger |
| D369,907 | S | | 5/1996 | Sayovitz et al. |
| 5,534,340 | A | | 7/1996 | Gupta et al. |
| 5,573,719 | A | | 11/1996 | Fitting |
| 5,573,841 | A | | 11/1996 | Adam et al. |
| 5,575,874 | A | | 11/1996 | Griesbach, III et al. |
| 5,587,225 | A | | 12/1996 | Griesbach et al. |
| 5,607,798 | A | | 3/1997 | Kobylivker et al. |
| 5,614,281 | A | | 3/1997 | Jackson et al. |
| 5,620,779 | A | | 4/1997 | Levy et al. |
| 5,635,290 | A | | 6/1997 | Stopper et al. |
| 5,643,240 | A | | 7/1997 | Jackson et al. |
| 5,647,883 | A | | 7/1997 | Houpt et al. |
| 5,652,051 | A | | 7/1997 | Shawver et al. |
| 5,704,101 | A | | 1/1998 | Majors et al. |
| 5,707,468 | A | | 1/1998 | Arnold et al. |
| D390,708 | S | | 2/1998 | Brown |
| 5,718,972 | A | | 2/1998 | Murase et al. |
| 5,719,219 | A | | 2/1998 | Shah et al. |
| 5,733,635 | A | | 3/1998 | Terakawa et al. |
| 5,759,926 | A | | 6/1998 | Pike et al. |
| 5,770,309 | A | | 6/1998 | Houpt et al. |
| 5,780,369 | A | | 7/1998 | Allison et al. |
| 5,783,503 | A | | 7/1998 | Gillespie et al. |
| 5,785,179 | A | | 7/1998 | Buczwinski et al. |
| 5,801,107 | A | | 9/1998 | Everhart et al. |
| 5,810,954 | A | | 9/1998 | Jacobs et al. |
| 5,814,390 | A | | 9/1998 | Stokes et al. |
| 5,817,199 | A | | 10/1998 | Brennecke et al. |
| 5,840,633 | A | | 11/1998 | Kurihara et al. |
| 5,853,635 | A | | 12/1998 | Morell et al. |
| 5,853,859 | A | | 12/1998 | Levy et al. |
| 5,858,504 | A | | 1/1999 | Fitting |
| 5,858,515 | A | | 1/1999 | Stokes et al. |
| 5,885,909 | A | | 3/1999 | Rudisill et al. |
| 5,895,710 | A | | 4/1999 | Sasse et al. |
| 5,914,084 | A | | 6/1999 | Benson et al. |
| 5,935,512 | A | | 8/1999 | Haynes et al. |
| 5,935,883 | A | | 8/1999 | Pike |
| 5,962,112 | A | | 10/1999 | Haynes et al. |
| 5,964,351 | A | | 10/1999 | Zander |
| 5,965,084 | A | | 10/1999 | Nishijima |
| 5,968,855 | A | | 10/1999 | Perdelwitz, Jr. et al. |
| 5,979,030 | A | | 11/1999 | Legare |
| 5,993,944 | A | | 11/1999 | Honna et al. |
| 6,004,673 | A | | 12/1999 | Nishijima |
| 6,022,818 | A | | 2/2000 | Welchel et al. |
| 6,030,331 | A | | 2/2000 | Zander |
| 6,063,717 | A | | 5/2000 | Ishiyama et al. |
| 6,069,097 | A | | 5/2000 | Suzuki et al. |
| 6,080,466 | A | | 6/2000 | Yoshimura et al. |
| D428,267 | S | | 7/2000 | Romano, III et al. |
| 6,093,665 | A | | 7/2000 | Sayovitz et al. |
| D428,710 | S | | 8/2000 | Romano, III et al. |
| 6,103,061 | A | | 8/2000 | Anderson et al. |
| 6,107,268 | A | | 8/2000 | Yahiaoui et al. |
| 6,110,848 | A | | 8/2000 | Bouchette |
| 6,114,263 | A | | 9/2000 | Benson et al. |
| 6,136,775 | A | | 10/2000 | Strout et al. |
| 6,150,002 | A | | 11/2000 | Varona |
| 6,158,614 | A | | 12/2000 | Haines et al. |
| 6,187,699 | B1 | | 2/2001 | Terakawa et al. |
| 6,197,404 | B1 | | 3/2001 | Varona |
| 6,200,669 | B1 | | 3/2001 | Marmon et al. |
| 6,258,196 | B1 | | 7/2001 | Suzuki et al. |
| 6,264,776 | B1 | | 7/2001 | DiPalma |
| 6,269,969 | B1 | | 8/2001 | Huang et al. |
| 6,269,970 | B1 | | 8/2001 | Huang et al. |
| 6,273,359 | B1 | | 8/2001 | Newman et al. |
| 6,314,627 | B1 | | 11/2001 | Ngai |
| 6,315,864 | B2 | | 11/2001 | Anderson et al. |
| 6,325,864 | B1 | | 12/2001 | Zahuranec et al. |

| | | | | |
|---|---|---|---|---|
| 6,375,889 | B1 | 4/2002 | Holmes et al. | |
| 6,381,817 | B1 | 5/2002 | Moody, III | |
| 6,460,233 | B2 | 10/2002 | Noelle | |
| 6,461,729 | B1 | 10/2002 | Dugan | |
| 6,550,115 | B1 * | 4/2003 | Skoog et al. | 28/104 |
| 6,723,669 | B1 | 4/2004 | Clark et al. | |
| 6,725,512 | B2 * | 4/2004 | Carter | 28/104 |
| 6,797,226 | B2 | 9/2004 | Annable | |
| 2001/0008180 | A1 | 7/2001 | Anderson et al. | |
| 2001/0037850 | A1 | 11/2001 | Marmon et al. | |
| 2002/0006502 | A1 | 1/2002 | Nagaoka et al. | |
| 2002/0007540 | A1 * | 1/2002 | Black et al. | 28/105 |
| 2002/0015069 | A1 | 2/2002 | Yamamoto et al. | |
| 2002/0034907 | A1 | 3/2002 | Groitzsch et al. | |
| 2002/0099347 | A1 | 7/2002 | Chen et al. | |
| 2002/0110655 | A1 | 8/2002 | Seth | |
| 2002/0132545 | A1 | 9/2002 | Lenz | |
| 2003/0003832 | A1 | 1/2003 | Childs et al. | |
| 2003/0118776 | A1 | 6/2003 | Anderson et al. | |
| 2003/0131919 | A1 | 7/2003 | King et al. | |
| 2003/0194932 | A1 | 10/2003 | Clark et al. | |
| 2003/0207636 | A1 | 11/2003 | Gosavi et al. | |
| 2003/0213108 | A1 * | 11/2003 | Strandqvist | 28/104 |
| 2004/0048542 | A1 * | 3/2004 | Thomaschefsky et al. | 422/389 |
| 2004/0121121 | A1 | 6/2004 | Anderson et al. | |
| 2004/0121689 | A1 | 6/2004 | Anderson et al. | |
| 2005/0091811 | A1 * | 5/2005 | Billgren et al. | 28/104 |
| 2005/0092417 | A1 | 5/2005 | Billgren et al. | |
| 2005/0112980 | A1 | 5/2005 | Strandqvist et al. | |

FOREIGN PATENT DOCUMENTS

| | | | |
|---|---|---|---|
| EP | 0171806 | A2 | 2/1986 |
| EP | 0624676 | B1 | 11/1994 |
| EP | 0669994 | B1 | 9/1995 |
| EP | 0685586 | A2 | 12/1995 |
| EP | 0685586 | A3 | 12/1995 |
| EP | 0719355 | B1 | 7/1996 |
| EP | 0765959 | B1 | 4/1997 |
| EP | 0796940 | A1 | 9/1997 |
| EP | 0872206 | A1 | 10/1998 |
| EP | 0949371 | A2 | 10/1999 |
| EP | 0963745 | A1 | 12/1999 |
| EP | 0992338 | A2 | 4/2000 |
| EP | 1050612 | A1 | 11/2000 |
| GB | 935124 | | 8/1963 |
| WO | WO 9920821 | A1 | 4/1999 |
| WO | WO 9920822 | A1 | 4/1999 |
| WO | WO 9922059 | A1 | 5/1999 |
| WO | WO 0008245 | A1 | 2/2000 |
| WO | WO 0141622 | A2 | 6/2001 |
| WO | WO 0141622 | A3 | 6/2001 |
| WO | WO 0188247 | A1 | 11/2001 |
| WO | WO 0234511 | A1 | 5/2002 |
| WO | WO 0238846 | A2 | 5/2002 |
| WO | WO 0238846 | A3 | 5/2002 |
| WO | WO 02064360 | A1 | 8/2002 |
| WO | WO 02064871 | A2 | 8/2002 |
| WO | WO 02064871 | A3 | 8/2002 |
| WO | WO 02076723 | A1 | 10/2002 |

OTHER PUBLICATIONS

Abstract of Japanese Patent No. 10072753, Mar. 17, 1998.
Abstract of Japanese Patent No. 11323715, Nov. 26, 19999.
Abstract of Japanese Patent No. 2182962, Jul. 17, 1990.
Abstract of Japanese Patent No. 4034058, Feb. 5, 1992
Abstract of Japanese Patent No. 4057950, Feb. 25, 1992.
Abstract of Japanese Patent No. 4257359, Sep. 11, 1992.
Abstract of Japanese Patent No. 4272219, Sep. 29, 1992.
Abstract of Japanese Patent No. 48033174, May 8, 1973.
Abstract of Japanese Patent No. 5179545, Jul. 20, 1993.
Abstract of Japanese Patent No. 5214653, Aug. 24, 1993.
Abstract of Japanese Patent No. 5214654, Aug. 24, 1993.
Abstract of Japanese Patent No. 5287660, Nov. 2, 1993.
Abstract of Japanese Patent No. 5321018, Dec. 7, 1993.
Abstract of Japanese Patent No. 6184823, Jul. 5, 1994.
Abstract of Japanese Patent No. 6207361, Jul. 26, 1994.
Abstract of Japanese Patent No. 62268861, Nov. 21, 1987.
Abstract of Japanese Patent No. 6264345, Sep. 20, 1994.
Abstract of Japanese Patent No. 6306754, Nov. 1, 1994.
Abstract of Japanese Patent No. 6313215, Nov. 8, 1994.
Abstract of Japanese Patent No. 6330447, Nov. 29, 1994.
Abstract of Japanese Patent No. 8260247, Oct. 8, 1996
Abstract of Japanese Patent No. 8311717, Nov. 26, 1996.
Abstract of Japanese Patent No. 8311718, Nov. 26, 1996.
PCT Search Report for PCT/US02/35120, Feb. 26, 2003.
PCT Search Report for PCT/US03/28824, Jan. 22, 2004.
PCT Search Report for PCT/US03/29175, Feb. 26, 2004.
Product Information for Kimberly-Clark Professional WYPALL® X Wipers, 2 pages, Mar. 6, 2003.
Article—"*Basic Chemistry of the Polyamides*," Polyamide Resins (Reinhold Plastics Applications Series), Don E. Floyd, General Mills, Inc., pp. 31-64.
Abstract of Japanese Patent No. 1026706, Jan. 30, 1989.
Search Report and Written Opinion for PCT/US2004/018875, Nov. 2, 2004.
Search Report and Written Opinion for PCT/US2004/018873, Nov. 5, 2004.

* cited by examiner

SOFT AND BULKY COMPOSITE FABRICS

BACKGROUND OF THE INVENTION

Domestic and industrial wipers are often used to quickly absorb both polar liquids (e.g., water and alcohols) and nonpolar liquids (e.g., oil). The wipers must have a sufficient absorption capacity to hold the liquid within the wiper structure until it is desired to remove the liquid by pressure, e.g., wringing. In addition, the wipers must also possess good physical strength and abrasion resistance to withstand the tearing, stretching and abrading forces often applied during use. Moreover, the wipers should also be soft to the touch.

In the past, nonwoven fabrics, such as meltblown nonwoven webs, have been widely used as wipers. Meltblown nonwoven webs possess an interfiber capillary structure that is suitable for absorbing and retaining liquid. However, meltblown nonwoven webs sometimes lack the requisite physical properties for use as a heavy-duty wiper, e.g., tear strength and abrasion resistance. Consequently, meltblown nonwoven webs are typically laminated to a support layer, e.g., a nonwoven web, which may not be desirable for use on abrasive or rough surfaces. Spunbond webs contain thicker and stronger fibers than meltblown nonwoven webs and may provide good physical properties, such as tear strength and abrasion resistance. However, spunbond webs sometimes lack fine interfiber capillary structures that enhance the adsorption characteristics of the wiper. Furthermore, spunbond webs often contain bond points that may inhibit the flow or transfer of liquid within the nonwoven webs. In response to these and other problems, composite fabrics were also developed that contained a nonwoven web of continuous filaments hydraulically entangled with pulp fibers. Although these fabrics possessed good levels of strength, they sometimes lacked good oil absorption characteristics.

In response to these and other problems, nonwoven composite fabrics were developed in which pulp fibers were hydraulically entangled with a nonwoven web of continuous filaments. These fabrics possessed good levels of strength, but often exhibited inadequate softness and handfeel. For example, hydraulic entanglement relies on high water volumes and pressures to entangle the fibers. Residual water may be removed through a series of drying cans. However, the high water pressures and the relatively high temperature of the drying cans essentially compresses or compacts the fibers into a stiff, low bulk structure. Thus, techniques were developed in an attempt to soften nonwoven composite fabrics without reducing strength to a significant extent. One such technique is described in U.S. Pat. No. 6,103,061 to Anderson, et al., which is incorporated herein in its entirety by reference thereto for all purposes. Anderson, et al. is directed to a nonwoven composite fabric that is subjected to mechanical softening, such as creping. Other attempts to soften composite materials included the addition of chemical agents, calendaring, and embossing. Despite these improvements, however, nonwoven composite fabrics still lack the level of softness and handfeel required to give them a "clothlike" feel.

As such, a need remains for a fabric that is strong, soft, and also exhibits good absorption properties for use in a wide variety of wiper applications.

SUMMARY OF THE INVENTION

In accordance with one embodiment of the present invention, a method for forming a fabric is disclosed. The method comprises hydraulically entangling staple fibers with a nonwoven web formed from continuous filaments to form a composite material. The staple fibers have an average fiber length of from about 0.3 to about 25 millimeters, wherein at least a portion of the staple fibers are synthetic. The composite material defines a first surface and a second surface, the first surface containing a preponderance of the staple fibers and the second surface containing a preponderance of the continuous filaments. Further, at least a portion of the staple fibers also protrude from the second surface.

In accordance with another embodiment of the present invention, a method for forming a fabric is disclosed. The method comprises hydraulically entangling staple fibers with a spunbond web formed from continuous filaments to form a composite material. The staple fibers have an average fiber length of from about 3 to about 8 millimeters, wherein at least about 50 wt. % of the staple fibers are synthetic. The bulk of the composite material is greater than about 5 $cm^3/g$.

In accordance with still another embodiment of the present invention, a composite fabric is disclosed that comprises staple fibers hydraulically entangled with a nonwoven web formed from continuous filaments. The staple fibers have an average fiber length of from about 0.3 to about 25 millimeters, wherein at least a portion of the staple fibers are synthetic. The composite fabric defines a first surface and a second surface, the first surface containing a preponderance of the staple fibers and the second surface containing a preponderance of the continuous filaments. Further, at least a portion of the staple fibers also protrude from the second surface.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
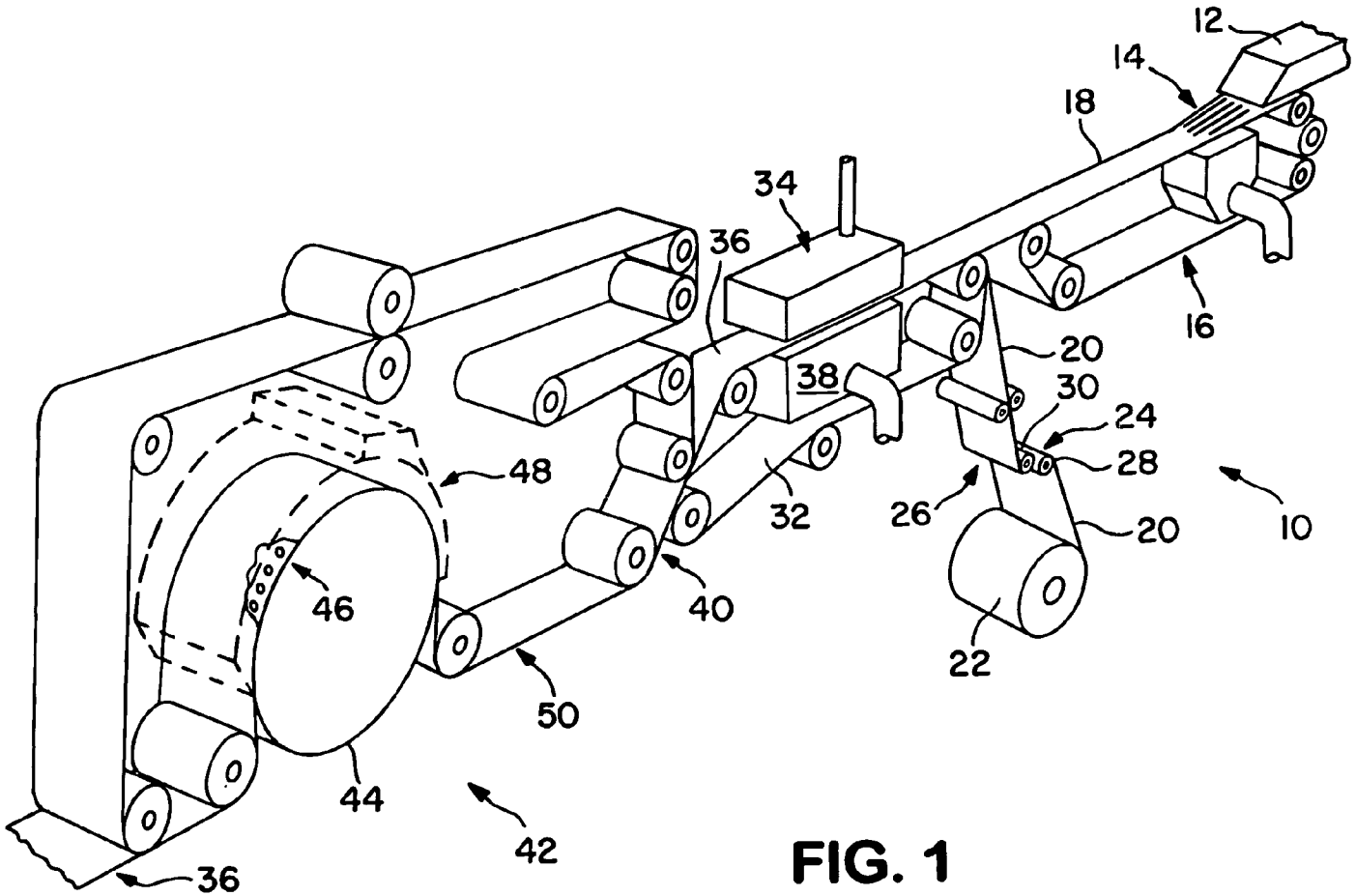
FIG. 1 is a schematic illustration of one embodiment for forming the composite fabric of the present invention.

Repeat use of reference characters in the present specification and drawings is intended to represent same or analogous features or elements of the invention.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment.

Thus, it is intended that the present invention covers such modifications and variations as come within the scope of the appended claims and their equivalents.

Definitions

As used herein, the term "continuous filaments" refer to filaments having a length much greater than their diameter, for example having a length to diameter ratio greater than about 15,000 to 1, and in some cases, greater than about 50,000 to 1.

As used herein, the term "nonwoven web" refers to a web having a structure of individual fibers or threads that are interlaid, but not in an identifiable manner as in a knitted fabric. Nonwoven webs include, for example, meltblown webs, spunbond webs, carded webs, wet-laid webs, airlaid webs, etc.

As used herein, the term "spunbond web" refers to a nonwoven web formed from small diameter continuous filaments. The web is formed by extruding a molten thermoplastic material as filaments from a plurality of fine, usually circular, capillaries of a spinnerette with the diameter of the extruded filaments then being rapidly reduced as by, for example, eductive drawing and/or other well-known spunbonding mechanisms. The production of spunbond webs is described and illustrated, for example, in U.S. Pat. No. 4,340,563 to Appel, et al., U.S. Pat. No. 3,692,618 to Dorschner, et al., U.S. Pat. No. 3,802,817 to Matsuki, et al., U.S. Pat. No. 3,338,992 to Kinney, U.S. Pat. No. 3,341,394 to Kinney, U.S. Pat. No. 3,502,763 to Hartman, U.S. Pat. No. 3,502,538 to Levy, U.S. Pat. No. 3,542,615 to Dobo, et al., and U.S. Pat. No. 5,382,400 to Pike, et al., which are incorporated herein in their entirety by reference thereto for all purposes. Spunbond fibers are generally not tacky when they are deposited onto a collecting surface. Spunbond fibers may sometimes have diameters less than about 40 microns, and are often between about 5 to about 20 microns.

As used herein, the term "meltblown web" refers to a nonwoven web formed by extruding a molten thermoplastic material through a plurality of fine, usually circular, die capillaries as molten threads or filaments into converging high velocity gas (e.g. air) streams that attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin, et al., which is incorporated herein in its entirety by reference thereto for all purposes. Generally speaking, meltblown fibers may be microfibers that may be continuous or discontinuous, are generally smaller than 10 microns in diameter, and are generally tacky when deposited onto a collecting surface.

As used herein the term "monocomponent" refer to fibers or filaments that include only one polymer component formed from one or more extruders. Although formed from one polymer component, monocomponent fibers or filaments may contain additives, such as those that provide color (e.g., $TiO_2$), antistatic properties, lubrication, hydrophilicity, etc.

As used herein, the term "multicomponent" refers to fibers or filaments formed from at least two polymer components. Such materials are usually extruded from separate extruders but spun together. The polymers of the respective components are usually different from each other, although separate components may be utilized that contain similar or identical polymeric materials. The individual components are typically arranged in substantially constantly positioned distinct zones across the cross-section of the fiber/filament and extend substantially along the entire length of the fiber/filament. The configuration of such materials may be, for example, a side-by-side arrangement, a pie arrangement, or any other arrangement. Bicomponent fibers or filaments and methods of making the same are taught in U.S. Pat. No. 5,108,820 to Kaneko, et al., U.S. Pat. No. 4,795,668 to Kruege, et al., U.S. Pat. No. 5,382,400 to Pike, et al., U.S. Pat. No. 5,336,552 to Strack, et al., and U.S. Pat. No. 6,200,669 to Marmon, et al., which are incorporated herein in their entirety by reference thereto for all purposes. Multicomponent fibers or filaments and individual components containing the same, may have various irregular shapes, such as those described in U.S. Pat. No. 5,277,976 to Hogle, et al., U.S. Pat. No. 5,162,074 to Hills, U.S. Pat. No. 5,466,410 to Hills, U.S. Pat. No. 5,069,970 to Largman, et al., and U.S. Pat. No. 5,057,368 to Largman, et al., which are incorporated herein in their entirety by reference thereto for all purposes.

As used herein, the term "average fiber length" refers to a weighted average length of fibers determined utilizing a Kajaani fiber analyzer model No. FS-100 available from Kajaani Oy Electronics, Kajaani, Finland. According to the test procedure, a sample is treated with a macerating liquid to ensure that no fiber bundles or shives are present. Each sample is disintegrated into hot water and diluted to an approximately 0.001% solution. Individual test samples are drawn in approximately 50 to 100 ml portions from the dilute solution when tested using the standard Kajaani fiber analysis test procedure. The weighted average fiber length may be expressed by the following equation:

$$\sum_{x_i}^{k} (x_i * n_i)/n$$

wherein, k=maximum fiber length $x_i$=fiber length $n_i$=number of fibers having length $x_i$; and n=total number of fibers measured.

As used herein, the term "low-average fiber length pulp" refers to pulp that contains a significant amount of short fibers and non-fiber particles. Many secondary wood fiber pulps may be considered low average fiber length pulps; however, the quality of the secondary wood fiber pulp will depend on the quality of the recycled fibers and the type and amount of previous processing. Low-average fiber length pulps may have an average fiber length of less than about 1.2 mm as determined by an optical fiber analyzer such as, for example, a Kajaani fiber analyzer model No. FS-100 (Kajaani Oy Electronics, Kajaani, Finland). For example, low average fiber length pulps may have an average fiber length ranging from about 0.7 to 1.2 mm. Exemplary low average fiber length pulps include virgin hardwood pulp, and secondary fiber pulp from sources such as, for example, office waste, newsprint, and paperboard scrap.

As used herein, the term "high-average fiber length pulp" refers to pulp that contains a relatively small amount of short fibers and non-fiber particles. High-average fiber length pulp is typically formed from certain non-secondary (i.e., virgin) fibers. Secondary fiber pulp that has been screened may also have a high-average fiber length. High-average fiber length pulps typically have an average fiber length of greater than about 1.5 mm as determined by an optical fiber analyzer such as, for example, a Kajaani fiber analyzer model No. FS-100 (Kajaani Oy Electronics, Kajaani, Finland). For example, a high-average fiber length pulp may have an average fiber length from about 1.5 mm to about 6 mm. Exemplary high-average fiber length pulps that are wood fiber pulps include, for example, bleached and unbleached virgin softwood fiber pulps.

DETAILED DESCRIPTION

In general, the present invention is directed to a composite fabric that contains staple fibers hydraulically entangled with a nonwoven web formed from continuous filaments. Without intending to be limited by theory, it is believed that the low coefficient of friction of the staple fibers enables them to more easily pass through the continuous filament nonwoven web during entanglement than other types of fibers. Consequently, one portion of the staple fibers is entangled with the web, while another portion protrudes through the web. The resulting surface topography has one surface with a preponderance of the smooth, staple fibers, and another surface with a preponderance of the continuous filaments from the nonwoven web, but also including some of the protruded smooth, staple fibers. Thus, each surface contains smooth staple fibers and is soft. Surprisingly, excellent liquid handling properties and bulk are also achieved with such a composite fabric.

To achieve a composite fabric possessing the desired "two-sided" softness characteristic referred to above, the materials and methods used to form the composite nonwoven fabric are selectively controlled. In this regard, various embodiments for selectively controlling aspects of the staple fibers, continuous filament nonwoven web, and the method for forming the composite fabric will now be described in more detail. It should be understood, however, that the embodiments discussed herein are merely exemplary.

A. Staple Fibers

The staple fibers are selected so that they are smooth, flexible, and able to extend through the continuous filament nonwoven web during entanglement. The average fiber length and denier of the staple fibers, for example, may affect the ability of the staple fibers to protrude through the continuous filament nonwoven web. The selected average fiber length and denier will generally depend on a variety of factors, including the nature of the staple fibers, the nature of the continuous filament web, the entangling pressures used, etc. The average fiber length of the staple fibers is generally low enough so that a portion of an individual fiber may readily entangle with the continuous filament nonwoven web, and also long enough so that another portion of the fiber is able to protrude therethrough. In this regard, the staple fibers typically have an average fiber length in the range of from about 0.3 to about 25 millimeters, in some embodiments from about 0.5 to about 10 millimeters, and in some embodiments, from about 3 to about 8 millimeters. The denier per filament of the staple fibers may also be less than about 6, in some embodiments less than about 3, and in some embodiments, from about 0.5 to about 3.

In addition, it is normally desired that a majority of the staple fibers utilized are synthetic. For example, at least about 50 wt. %, in some embodiments at least about 70 wt. %, and in some embodiments, at least about 90 wt. % of the staple fibers entangled with the continuous filament nonwoven web are synthetic. Without intending to be limited by theory, the present inventors believe that synthetic staple fibers may be smooth and have a low coefficient of friction, thereby enabling them to more easily pass through the continuous filament nonwoven web during entanglement. Some examples of suitable synthetic staple fibers include, for instance, those formed from polymers such as, polyvinyl alcohol, rayon (e.g., lyocel), polyester, polyvinyl acetate, nylon, polyolefins, etc.

Although a substantial portion of the staple fibers is typically synthetic, some portion of the staple fibers may also be cellulosic. For example, cellulosic fibers may be utilized to reduce costs, as well as impart other benefits to the composite fabric, such as improved absorbency. Some examples of suitable cellulosic fiber sources include virgin wood fibers, such as thermomechanical, bleached and unbleached pulp fibers. Pulp fibers may have a high-average fiber length, a low-average fiber length, or mixtures of the same. Some examples of suitable high-average length pulp fibers include, but are not limited to, northern softwood, southern softwood, redwood, red cedar, hemlock, pine (e.g., southern pines), spruce (e.g., black spruce), combinations thereof, and so forth. Exemplary high-average fiber length wood pulps include those available from the Kimberly-Clark Corporation under the trade designation "Longlac 19". Some examples of suitable low-average fiber length pulp fibers may include, but are not limited to, certain virgin hardwood pulps and secondary (i.e. recycled) fiber pulp from sources such as, for example, newsprint, reclaimed paperboard, and office waste. Hardwood fibers, such as eucalyptus, maple, birch, aspen, and so forth, may also be used as low-average length pulp fibers. Mixtures of high-average fiber length and low-average fiber length pulps may be used. Secondary or recycled fibers, such as obtained from office waste, newsprint, brown paper stock, paperboard scrap, etc., may also be used. Further, vegetable fibers, such as abaca, flax, milkweed, cotton, modified cotton, cotton linters, may also be used.

Generally, many types of cellulosic fibers are believed to have a higher coefficient of friction than synthetic staple fibers. For this reason, when utilized, cellulosic fibers typically comprise less than about 50 wt. %, in some embodiments less than about 30 wt. %, and in some embodiments, less than about 10 wt. % of the staple fibers entangled with the continuous filament nonwoven web.

The staple fibers may also be monocomponent and/or multicomponent (e.g., bicomponent). For example, suitable configurations for the multicomponent fibers include side-by-side configurations and sheath-core configurations, and suitable sheath-core configurations include eccentric sheath-core and concentric sheath-core configurations. In some embodiments, as is well known in the art, the polymers used to form the multicomponent fibers have sufficiently different melting points to form different crystallization and/or solidification properties. The multicomponent fibers may have from about 20% to about 80%, and in some embodiments, from about 40% to about 60% by weight of the low melting polymer. Further, the multicomponent fibers may have from about 80% to about 20%, and in some embodiments, from about 60% to about 40%, by weight of the high melting polymer. When utilized, multicomponent fibers may have a variety of benefits. For example, the larger fiber denier sometimes provided by multicomponent fibers may provide a textured surface for the resulting fabric. In addition, multicomponent fibers may also enhance bulk and the level of bonding between the staple fibers and continuous filaments of the nonwoven web after entanglement.

Prior to entanglement, the staple fibers are generally formed into a web. The manner in which the web is formed may vary depending on a variety of factors, such as the length of the staple fibers utilized. In one embodiment, for instance, a staple fiber web may be formed using a wet-laying process according to conventional papermaking techniques. In a wet-laying process, a staple fiber furnish is combined with water to form an aqueous suspension. The solids consistency of the aqueous suspension typically ranges from 0.01 wt. % to about 1 wt. %. Lower consistencies (e.g., from about 0.01wt. % to about 0.1wt. %), however, may more readily accommodate longer fibers than higher consistencies (e.g., from about 0.1wt. % to about 1wt. %). The aqueous suspension is deposited onto a wire or felt using, for example, a single- or multi-layered headbox. Thereafter, the deposited suspension is dried to form the staple fiber web.

Besides wet-laying, however, other conventional web-forming techniques may also be utilized. For example, staple fibers may be formed into a carded web. Such webs may be formed by placing bales of staple fibers into a picker that separates the fibers. Next, the fibers are sent through a combing or carding unit that further breaks apart and aligns the staple fibers in the machine direction so as to form a machine direction-oriented fibrous nonwoven web. Air-laying is another well-known process by which staple fibers may be formed into a web. In air-laying processes, bundles of the staple fibers are separated and entrained in an air supply and then deposited onto a forming screen, optionally with the assistance of a vacuum supply. Air-laying and carding processes may be particularly suitable for forming a web from longer staple fibers. Still other processes may also be used to form staple fibers into a web.

If desired, the staple fiber web may sometimes be bonded using known methods to improve its temporary dry strength for winding, transport, and unwinding. One such bonding method is powder bonding, wherein a powdered adhesive is distributed throughout the web and then activated, usually by heating the web and adhesive with hot air. Another bonding method is pattern bonding, wherein heated calendar rolls or ultrasonic bonding equipment is used to bond the fibers together, usually in a localized bond pattern. Still another method involves using a through-air dryer to bond the web. Specifically, heated air is forced through the web to melt and bond together the fibers at their crossover points. Typically, the unbonded staple fiber web is supported on a forming wire or drum. Through-air bonding is particularly useful for webs formed from multicomponent staple fibers.

In some cases, the staple fiber web may be imparted with temporary dry strength for winding, transport, and unwinding using a strength-enhancing component. For example, hot-water soluble polyvinyl alcohol fibers may be utilized. These fibers dissolve at a certain temperature, such as greater than about 120° F. Consequently, the hot-water soluble fibers may be contained within the web during winding, transport, and unwinding, and simply dissolved away from the staple fibers prior to entanglement. Alternatively, the strength of such fibers may simply be weakened by raising the temperature to an extent less than required to completely dissolve the fibers. Some examples of such fibers include, but are not limited to, VPB 105-1 (158° F.), VPB 105-2 (140° F.), VPB 201 (176° F.), or VPB 304 (194° F.) staple fibers made by Kuraray Company, Ltd. (Japan). Other examples of suitable polyvinyl alcohol fibers are disclosed in U.S. Pat. No. 5,207,837, which is incorporated herein in its entirety by reference thereto for all purposes. When utilized to improve temporary dry strength prior to entanglement, the strength-enhancing component may comprise from about 3 wt. % to about 15 wt. % of the nonwoven web, in some embodiments from about 4 wt. % to about 10 wt. % of the nonwoven web, and in some embodiments, from about 5 wt. % to about 8 wt. % of the staple fiber web. It should be understood that the strength-enhancing fibers described above may also be utilized as staple fibers in the present invention. For example, as noted above, polyvinyl alcohol fibers may be utilized as staple fibers.

B. Continuous Filament Nonwoven Web

A variety of known techniques may be utilized to form the continuous filament nonwoven web. Some examples of continuous filament nonwoven extrusion processes include, but are not limited to, known solvent spinning or melt-spinning processes. In one embodiment, for example, the continuous filament nonwoven web is a spunbond web. The filaments of the nonwoven web may be monocomponent or multicomponent, and may generally be formed from one or more thermoplastic polymers. Examples of such polymers include, but are not limited to, polyolefins, polyamides, polyesters, polyurethanes, blends and copolymers thereof, and so forth. Desirably, the thermoplastic filaments contain polyolefins, and even more desirably, polypropylene and/or polyethylene. Suitable polymer compositions may also have thermoplastic elastomers blended therein, as well as contain pigments, antioxidants, flow promoters, stabilizers, fragrances, abrasive particles, fillers, and so forth. The denier per filament of the continuous filaments used to form the nonwoven web may also vary. For instance, in one particular embodiment, the denier per filament of a continuous filament used to form the nonwoven web is less than about 6, in some embodiments less than about 3, and in some embodiments, from about 1 to about 3.

Although not required, the nonwoven web may also be bonded to improve the durability, strength, hand, aesthetics and/or other properties of the web. For instance, the nonwoven web may be thermally, ultrasonically, adhesively and/or mechanically bonded. As an example, the nonwoven web may be point bonded such that it possesses numerous small, discrete bond points. An exemplary point bonding process is thermal point bonding, which generally involves passing one or more layers between heated rolls, such as an engraved patterned roll and a second bonding roll. The engraved roll is patterned in some way so that the web is not bonded over its entire surface, and the second roll may be smooth or patterned. As a result, various patterns for engraved rolls have been developed for functional as well as aesthetic reasons. Exemplary bond patterns include, but are not limited to, those described in U.S. Pat. No. 3,855,046 to Hansen, et al., U.S. Pat. No. 5,620,779 to Levy, et al., U.S. Pat. No. 5,962,112 to Haynes, et al., U.S. Pat. No. 6,093,665 to Sayovitz, et al., U.S. Design Pat. No. 428,267 to Romano, et al. and U.S. Design Pat. No. 390,708 to Brown, which are incorporated herein in their entirety by reference thereto for all purposes. For instance, in some embodiments, the nonwoven web may be optionally bonded to have a total bond area of less than about 30% (as determined by conventional optical microscopic methods) and/or a uniform bond density greater than about 100 bonds per square inch. For example, the nonwoven web may have a total bond area from about 2% to about 30% and/or a bond density from about 250 to about 500 pin bonds per square inch. Such a combination of total bond area and/or bond density may, in some embodiments, be achieved by bonding the nonwoven web with a pin bond pattern having more than about 100 pin bonds per square inch that provides a total bond surface area less than about 30% when fully contacting a smooth anvil roll. In some embodiments, the bond pattern may have a pin bond density from about 250 to about 350 pin bonds per square inch and/or a total bond surface area from about 10% to about 25% when contacting a smooth anvil roll.

Further, the nonwoven web may be bonded by continuous seams or patterns. As additional examples, the nonwoven web may be bonded along the periphery of the sheet or simply across the width or cross-direction (CD) of the web adjacent the edges. Other bond techniques, such as a combination of thermal bonding and latex impregnation, may also be used. Alternatively and/or additionally, a resin, latex or adhesive may be applied to the nonwoven web by, for example, spraying or printing, and dried to provide the desired bonding. Still other suitable bonding techniques may be described in U.S. Pat. No. 5,284,703 to Everhart, et al., U.S. Pat. No. 6,103,061 to Anderson, et al., and U.S. Pat. No. 6,197,404 to Varona, which are incorporated herein in its entirety by reference thereto for all purposes.

The nonwoven web is also optionally creped. Creping may impart microfolds into the web to provide a variety of different characteristics thereto. For instance, creping may open the pore structure of the nonwoven web, thereby increasing its permeability. Moreover, creping may also enhance the stretchability of the web in the machine and/or cross-machine directions, as well as increase its softness and bulk. Various techniques for creping nonwoven webs are described in U.S. Pat. No. 6,197,404 to Varona, which is incorporated herein in its entirety by reference thereto for all purposes.

C. Method for Forming the Fabric

The composite fabric is formed by integrally entangling the continuous filament nonwoven web with the staple fibers using any of a variety of entanglement techniques known in the art (e.g., hydraulic, air, mechanical, etc.). A typical hydraulic entangling process utilizes high pressure jet streams of water to entangle the fibers and filaments to form a highly entangled consolidated composite structure. Hydraulic entangled nonwoven composite materials are disclosed, for example, in U.S. Pat. No. 3,494,821 to Evans; U.S. Pat. No. 4,144,370 to Bouolton; U.S. Pat. No. 5,284,703 to Everhart, et al.; and U.S. Pat. No. 6,315,864 to Anderson, et al., which are incorporated herein in their entirety by reference thereto for all purposes.

The continuous filament nonwoven web may generally comprise any desired amount of the resulting composite fabric. For example, in some embodiments, the continuous filament nonwoven web may comprise less than about 60% by weight of the fabric, and in some embodiments, in some embodiments less than about 50% by weight of the fabric, and in some embodiments, from about 10% to about 40% by weight of the fabric. Likewise, the staple fibers may comprise greater than about 40% by weight of the fabric, in some embodiments greater than about 50% by weight of the fabric, and in some embodiments, between about 60% to about 90% by weight of the fabric.

In accordance with one aspect of the present invention, certain parameters of the entangling process may be selectively controlled to achieve a "two-sided" softness characteristic for the resulting composite fabric. In this regard, referring to FIG. 1, various embodiments for selectively controlling the process for forming the composite fabric using a hydraulic entangling apparatus 10 will now be described in more detail.

Initially, a slurry is provided containing, for example, from about 0.01 wt. % to about 1 wt. % by weight staple fibers suspended in water. The fibrous slurry is conveyed to a conventional papermaking headbox 12 where it is deposited via a sluice 14 onto a conventional forming fabric or surface 16. Water is then removed from the suspension of staple fibers to form a uniform layer 18. Small amounts of wet-strength resins and/or resin binders may be added to the staple fibers before, during, and/or after formation of the layer 18 to improve strength and abrasion resistance. Crosslinking agents and/or hydrating agents may also be added. Debonding agents may be added to the staple fibers to reduce the degree of hydrogen bonding. The addition of certain debonding agents in the amount of, for example, about 1% to about 4% percent by weight of the fabric also appears to reduce the measured static and dynamic coefficients of friction and improve the abrasion resistance of the composite fabric. The debonding agent is believed to act as a lubricant or friction reducer.

A continuous filament nonwoven web 20 is also unwound from a rotating supply roll 22 and passes through a nip 24 of a S-roll arrangement 26 formed by the stack rollers 28 and 30. The continuous filament nonwoven web 20 is then placed upon a foraminous entangling surface 32 of a conventional hydraulic entangling machine where the staple fiber layer 18 are then laid on the web 20. Although not required, it is typically desired that the staple fiber layer 18 be positioned between the continuous filament nonwoven web 20 and the hydraulic entangling manifolds 34. The staple fiber layer 18 and the continuous filament nonwoven web 20 pass under one or more hydraulic entangling manifolds 34 and are treated with jets of fluid to entangle the staple fiber layer 18 with the filaments of the nonwoven web 20, and drive them into and through the nonwoven web 20 to form a composite fabric 36. Alternatively, hydraulic entangling may take place while the staple fiber layer 18 and the continuous filament nonwoven web 20 are on the same foraminous screen (e.g., mesh fabric) that the wet-laying took place. The present invention also contemplates superposing a dried staple fiber layer 18 on the continuous filament nonwoven web 20, rehydrating the dried sheet to a specified consistency and then subjecting the rehydrated sheet to hydraulic entangling. The hydraulic entangling may take place while the staple fiber layer 18 is highly saturated with water. For example, the staple fiber layer 18 may contain up to about 90% by weight water just before hydraulic entangling. Alternatively, the staple fiber layer 18 may be an air-laid or dry-laid layer.

Hydraulic entangling may be accomplished utilizing conventional hydraulic entangling equipment such as described in, for example, in U.S. Pat. No. 5,284,703 to Everhart, et al. and U.S. Pat. No. 3,485,706 to Evans, which are incorporated herein in their entirety by reference thereto for all purposes. Hydraulic entangling may be carried out with any appropriate working fluid such as, for example, water. The working fluid flows through a manifold that evenly distributes the fluid to a series of individual holes or orifices. These holes or orifices may be from about 0.003 to about 0.015 inch in diameter and may be arranged in one or more rows with any number of orifices, e.g., 30–100 per inch, in each row. For example, a manifold produced by Fleissner, Inc. of Charlotte, N.C., containing a strip having 0.007-inch diameter orifices, 30 holes per inch, and 1 row of holes may be utilized. However, it should also be understood that many other manifold configurations and combinations may be used. For example, a single manifold may be used or several manifolds may be arranged in succession.

Fluid may impact the staple fiber layer 18 and the continuous filament nonwoven web 20, which are supported by a foraminous surface, such as a single plane mesh having a mesh size of from about 10×10 to about 100×100. The foraminous surface may also be a multi-ply mesh having a mesh size from about 50×50 to about 200×200. As is typical in many water jet treatment processes, vacuum slots 38 may be located directly beneath the hydro-needling manifolds or beneath the foraminous entangling surface 32 downstream of the entangling manifold so that excess water is withdrawn from the hydraulically entangled composite fabric 36.

Although not held to any particular theory of operation, it is believed that the columnar jets of working fluid that directly impact the staple fiber layer 18 laying on the continuous filament nonwoven web 20 work to drive the staple fibers into and partially through the matrix or network of fibers in the web 20. Namely, when the fluid jets and the staple fiber layer 18 interact with the continuous filament nonwoven web 20, a portion of the individual staple fibers may protrude through the web 20, while another portion is entangled with the web 20. The ability of the staple fibers to protrude through the continuous filament nonwoven web 20 in this manner may be facilitated through selective control over the pressure of the columnar jets. If the pressure is too high, the staple fibers may extend too far through the web 20 and not possess the desired degree of entanglement. On the other hand, if the pressure is too low, the staple fibers may not protrude through the web 20. A variety of factors influence the optimum pressure, such as the type of staple fibers, the type of continuous filaments, the basis weight and caliper of the nonwoven web, etc. In most embodiments, the desired results may be achieved with a fluid pressure that ranges from about 100 to about 4000 psig, in some embodiments from about 200 to about 3500 psig, and in some embodiments, from about 300 to about 2400 psig. When processed at the upper ranges of the described pressures, the composite fabric 36 may be processed at speeds of up to about 1000 feet per minute (fpm).

After the fluid jet treatment, the resulting composite fabric 36 may then be transferred to a drying operation (e.g., compressive, non-compressive, etc.). A differential speed pickup roll may be used to transfer the material from the hydraulic needling belt to the drying operation. Alternatively, conventional vacuum-type pickups and transfer fabrics may be used. If desired, the composite fabric 36 may be wet-creped before being transferred to the drying operation.

Desirably, non-compressive drying of the material 36 is utilized so that the staple fibers present on the surface of the fabric 36 are not flattened, thus reducing the desired "two sided" softness and bulk. For example, in one embodiment, non-compressive drying may be accomplished utilizing a conventional through-dryer 42. The through-dryer 42 may be an outer rotatable cylinder 44 with perforations 46 in combination with an outer hood 48 for receiving hot air blown through the perforations 46. A through-dryer belt 50 carries the composite fabric 36 over the upper portion of the through-dryer outer cylinder 40. The heated air forced through the perforations 46 in the outer cylinder 44 of the through-dryer 42 removes water from the composite fabric 36. The temperature of the air forced through the composite fabric 36 by the through-dryer 42 may range from about 200° F. to about 500° F. Other useful through-drying methods and apparatuses may be found in, for example, U.S. Pat. No. 2,666,369 to Niks and U.S. Pat. No. 3,821,068 to Shaw, which are incorporated herein in their entirety by reference thereto for all purposes.

As stated, certain drying techniques (e.g., compressive) may flatten the staple fibers protruding from the surface thereof. Although not required, additional finishing steps and/or post treatment processes may be used to reduce this "flattening" affect and/or to impart other selected properties to the composite fabric 36. For example, the fabric 36 may be brushed to improve bulk. The fabric 36 may also be lightly pressed by calender rolls, creped, or otherwise treated to enhance stretch and/or to provide a uniform exterior appearance and/or certain tactile properties. For example, suitable creping techniques are described in U.S. Pat. No. 3,879,257 to Gentile, et al. and U.S. Pat. No. 6,315,864 to Anderson, et al., which are incorporated herein in their entirety by reference thereto for all purposes. Alternatively or additionally, various chemical post-treatments such as, adhesives or dyes may be added to the fabric 36. Additional post-treatments that may be utilized are described in U.S. Pat. No. 5,853,859 to Levy, et al., which is incorporated herein in its entirety by reference thereto for all purposes.

The entanglement of the staple fibers and continuous filament nonwoven web in accordance with the present invention results in a composite fabric having a variety of benefits. For instance, the composite fabric possesses a "two-sided" softness. That is, although a portion of the staple fibers are driven through and into the matrix of the continuous filament nonwoven web, some of the staple fibers will still remain at or near a surface of the composite fabric. This surface may thus contain a greater proportion of staple fibers, while the other surface may contain a greater proportion of the continuous filaments. One surface has a preponderance of staple fibers, giving it a very soft, velvety-type feel. For example, the surface may contain greater than about 50 wt. % staple fibers. The other surface has a preponderance of the continuous filaments, giving it a slicker, more plastic-like feel. For example, the surface may contain greater than about 50wt. % continuous filaments. Nevertheless, due to the presence of protruded staple fibers on the surface containing a preponderance of continuous filaments, it is also soft.

Besides having improved softness, the composite fabric may also possess improved bulk. Specifically, without intending to be limited by theory, the staple fibers within the fabric, particularly those contained on the side of the fabric having a preponderance of staple fibers, are believed to be primarily oriented in the −z direction (i.e., the direction of the thickness of the fabric). As a result, the bulk of the fabric is enhanced, and may be greater than about 5 $cm^3/g$, in some embodiments from about 7 $cm^3/g$ to about 50 $cm^3/g$, and in some embodiments, from about 10 $cm^3/g$ to about 40 $cm^3/g$. In addition, the present inventors have also discovered that the composite fabric has good oil and water absorption characteristics.

D. Wiper

The composite fabric of the present invention is particularly useful as a wiper. The wiper may have a basis weight of from about 20 grams per square meter ("gsm") to about 300 gsm, in some embodiments from about 30 gsm to about 200 gsm, and in some embodiments, from about 50 gsm to about 150 gsm. Lower basis weight products are typically well suited for use as light duty wipers, while higher basis weight products are well suited as industrial wipers. The wipers may also have any size for a variety of wiping tasks. The wiper may also have a width from about 8 centimeters to about 100 centimeters, in some embodiments from about 10 to about 50 centimeters, and in some embodiments, from about 20 centimeters to about 25 centimeters. In addition, the wiper may have a length from about 10 centimeters to about 200 centimeters, in some embodiments from about 20 centimeters to about 100 centimeters, and in some embodiments, from about 35 centimeters to about 45 centimeters.

If desired, the wiper may also be pre-moistened with a liquid, such as water, a waterless hand cleanser, or any other suitable liquid. The liquid may contain antiseptics, fire retardants, surfactants, emollients, humectants, and so forth.

In one embodiment, for example, the wiper may be applied with a sanitizing formulation, such as described in U.S. Patent Application Publication No. 2003/0194932 to Clark, et al., which is incorporated herein in its entirety by reference thereto for all purposes. The liquid may be applied by any suitable method known in the art, such as spraying, dipping, saturating, impregnating, brush coating and so forth. The amount of the liquid added to the wiper may vary depending upon the nature of the composite fabric, the type of container used to store the wipers, the nature of the liquid, and the desired end use of the wipers. Generally, each wiper contains greater than about 150 wt. %, in some embodiments from about 150 to about 1500 wt. %, and in some embodiments, from about 300 to about 1200 wt. % of the liquid based on the dry weight of the wiper.

In one embodiment, the wipers are provided in a continuous, perforated roll. Perforations provide a line of weakness by which the wipers may be more easily separated. For instance, in one embodiment, a 6" high roll contains 12" wide wipers that are v-folded. The roll is perforated every 12 inches to form 12"×12" wipers. In another embodiment, the wipers are provided as a stack of individual wipers. The wipers may be packaged in a variety of forms, materials and/or containers, including, but not limited to, rolls, boxes, tubs, flexible packaging materials, and so forth. For example, in one embodiment, the wipers are inserted on end in a selectively resealable container (e.g., cylindrical). Some examples of suitable containers include rigid tubs, film pouches, etc. One particular example of a suitable container for holding the wipers is a rigid, cylindrical tub (e.g., made from polyethylene) that is fitted with a re-sealable air-tight lid (e.g., made from polypropylene) on the top portion of the container. The lid has a hinged cap initially covering an opening positioned beneath the cap. The opening allows for the passage of wipers from the interior of the sealed container whereby individual wipers may be removed by grasping the wiper and tearing the seam off each roll. The opening in the lid is appropriately sized to provide sufficient pressure to remove any excess liquid from each wiper as it is removed from the container.

Other suitable wiper dispensers, containers, and systems for delivering wipers are described in U.S. Pat. No. 5,785,179 to Buczwinski, et al.; U.S. Pat. No. 5,964,351 to Zander; U.S. Pat. No. 6,030,331 to Zander; U.S. Pat. No. 6,158,614 to Haynes, et al.; U.S. Pat. No. 6,269,969 to Huang, et al.; U.S. Pat. No. 6,269,970 to Huang, et al.; and U.S. Pat. No. 6,273,359 to Newman, et al., which are incorporated herein in their entirety by reference thereto for all purposes.

The present invention may be better understood with reference to the following examples.

Test Methods

The Following Test Methods are Utilized in the Examples.

Bulk: Bulk is defined as the dry caliper of one sheet of the product divided by its basis weight. The bulk is measured in dimensions of centimeters cubed divided by grams ($cm^3/g$). The dry caliper is the thickness of a dry product measured under a controlled load. The bulk is determined in the following manner. Generally, an instrument, such as the EMVECO Model 200-A caliper tester from Emveco Co., is utilized. In particular, five (5) samples about 4 inches in length by about 4 inches in width are individually subjected to pressure. In particular, a platen, which is a circular piece of metal that is 2.21 inches in diameter, presses down upon the sheet. The pressure exerted by the platen is generally about 2 kilopascals (0.29 psi). Once the platen presses down upon the sheet, the caliper is measured. The platen then lifts back up automatically. The average of the five (5) sheets is recorded as the caliper. The basis weight is determined after conditioning the sample in TAPPI-specified temperature and humidity conditions.

Absorption Capacity: The absorption capacity refers to the capacity of a material to absorb a liquid (e.g., water or light machine oil) over a period of time and is related to the total amount of liquid held by the material at its point of saturation. The absorption capacity is measured in accordance with Federal Specification No. UU-T-595C on industrial and institutional towels and wiping papers. Specifically, absorption capacity is determined by measuring the increase in the weight of the sample resulting from the absorption of a liquid and is expressed, in percent, as the weight of liquid absorbed divided by the weight of the sample by the following equation:

$$\text{Absorption Capacity}=[(\text{saturated sample weight}-\text{sample weight})/\text{sample weight}]\times 100.$$

The light machine oil utilized to perform the test was white mineral oil available from E.K. Industries as part number "6228-1GL." The oil was designated "NF Grade" and had a Saybolt Universal (SU) viscosity of 80 to 90.

Taber Abrasion Resistance: Taber Abrasion resistance measures the abrasion resistance in terms of destruction of the fabric produced by a controlled, rotary rubbing action. Abrasion resistance is measured in accordance with Method 5306, Federal Test Methods Standard No. 191A, except as otherwise noted herein. Only a single wheel is used to abrade the specimen. A 12.7×12.7-cm specimen is clamped to the specimen platform of a Taber Standard Abrader (Model No. 504 with Model No. E-140-15 specimen holder) having a stone wheel (No. H-18) on the abrading head and a 500-gram counterweight on each arm. The loss in breaking strength is not used as the criteria for determining abrasion resistance. The results are obtained and reported in abrasion cycles to failure where failure was deemed to occur at that point where a 0.5-cm hole is produced within the fabric.

EXAMPLE 1

The ability to form a composite fabric in accordance with the present invention was demonstrated.

Twenty (20) different samples were formed from synthetic staple fibers having an average fiber length of 6.35 millimeters (lyocel and/or polyester) and optionally pulp fibers using a low consistency wet-lay papermaking machine as is well known in the art. The lyocel fibers had a denier per filament of 1.5, and were obtained from Engineered Fibers Technologies, Inc. of Shelton, Conn. under the name "Tencel." The polyester fibers were monocomponent fibers having a denier of 1.5, and were obtained from Kosa under the name "Type 103." The pulp fibers contained 50 wt. % northern softwood kraft fibers and 50 wt. % southern softwood kraft fibers. For some samples, polyvinyl alcohol fibers were also added prior to forming the staple fiber web to enhance its dry strength prior to entanglement. The polyvinyl alcohol fibers were obtained from Kuraray Co., Ltd. of Osaka, Japan under the trade name "VPB-105-1", which dissolve in water at a temperature of 158° F. The resulting wet-laid staple fiber webs had a basis weight ranging from about 40 to about 100 grams per square meter.

The content of the staple fiber webs used to form Samples 1–20 is set forth below in Table 1.

TABLE 1

Staple Fiber Content of Samples 1–20

| Sample | Basis Wt. ($g/m^2$) | % Pulp | % Lyocel | % Polyester | % Polyvinyl Alcohol* |
|---|---|---|---|---|---|
| 1 | 54.4 | 0 | 56.2 | 37.5 | 6.3 |
| 2 | 54.4 | 0 | 56.2 | 37.5 | 6.3 |
| 3 | 40.8 | 0 | 56.2 | 37.5 | 6.3 |
| 4 | 40.8 | 0 | 56.2 | 37.5 | 6.3 |
| 5 | 97.8 | 0 | 56.2 | 37.5 | 6.3 |
| 6 | 54.4 | 0 | 56.2 | 37.5 | 6.3 |
| 7 | 54.4 | 0 | 56.2 | 37.5 | 6.3 |
| 8 | 40.8 | 0 | 56.2 | 37.5 | 6.3 |
| 9 | 40.8 | 0 | 56.2 | 37.5 | 6.3 |
| 10 | 54.4 | 46.85 | 0 | 46.85 | 6.3 |
| 11 | 54.4 | 46.85 | 0 | 46.85 | 6.3 |
| 12 | 54.4 | 100 | 0 | 0 | 0 |
| 13 | 97.8 | 100 | 0 | 0 | 0 |
| 14 | 54.4 | 0.0 | 0 | 93.7 | 6.3 |
| 15 | 54.4 | 0.0 | 0 | 93.7 | 6.3 |
| 16 | 40.8 | 0.0 | 0 | 93.7 | 6.3 |
| 17 | 40.8 | 0.0 | 0 | 93.7 | 6.3 |
| 18 | 67.0 | 100 | 0 | 0 | 0 |
| 19 | 71.0 | 90.5 | 0 | 9.5 | 0 |
| 20 | 61.0 | 72.0 | 0 | 28.0 | 0 |

* The % polyvinyl alcohol (PVOH) values represent fiber weights added. As described below, the sheet was saturated with water during the hydroentangling step at a temperature of 130° F. to 180° F. to dissolve the PVOH fibers into solution (to allow the fiber to entangle). The sheet was then vacuumed over a vacuum slot, so that about one half of the dissolved PVOH/water solution was removed. During entangling with water jets, some of the PVOH may have precipitatedas a coating and created some fiber bonding in the drying step. If left behind, it is likely that such PVOH fibers would have been present in an amount of about 5 to 25 wt. % of the original amount, or at a total concentration of about 0 to 1 wt. %.

Each staple fiber web was then entangled with a polypropylene spunbond web (basis weight of 13.6 or 27.2 grams per square meter) in accordance with U.S. Pat. No. 5,204,703 to Everhart, et al. Specifically, the staple fiber web was deposited onto an Albany 14FT forming wire available from Albany International, and hydraulically entangled with a spunbond web at with entangling pressures ramped from 300 to 1800 pounds per square inch using several consecutive manifolds. The water used during the entangling process was at a temperature of 130 to 180° F., and thus dissolved the polyvinyl alcohol fibers and removed them from the fabric. The entangled fabric was then non-compressively dried for 1 minute with a through-air dryer (air at a temperature of 280° F.) so that the fabric reached a maximum temperature of up to 200° F. The resulting fabric samples had a basis weight ranging from about 50 to 125 grams per square meter, and contained varying percentages of the spunbond web and the staple fibers. The basis weight and total fiber content of Samples 1–20 are set forth below in Table 2.

TABLE 2

Basis Weight and Total Fiber Content of Samples 1–20*

| Sample | Basis Weight (gsm) | Staple Fibers (wt. %) | 13.6 gsm Spunbond Web (wt. %) | 27.2 gsm Spunbond Web (wt. %) |
|---|---|---|---|---|
| 1 | 68.0 | 80.0 | 20.0 | 0 |
| 2 | 81.6 | 66.7 | 0 | 33.3 |
| 3 | 68.0 | 60.0 | 0 | 40.0 |
| 4 | 54.4 | 75.0 | 25.0 | 0 |
| 5 | 125.0 | 78.2 | 0 | 21.8 |
| 6 | 81.6 | 66.7 | 0 | 33.3 |
| 7 | 68.0 | 80.0 | 20.0 | 0 |

TABLE 2-continued

Basis Weight and Total Fiber Content of Samples 1–20*

| Sample | Basis Weight (gsm) | Staple Fibers (wt. %) | 13.6 gsm Spunbond Web (wt. %) | 27.2 gsm Spunbond Web (wt. %) |
|---|---|---|---|---|
| 8 | 54.4 | 75.0 | 25.0 | 0 |
| 9 | 68.0 | 60.0 | 0 | 40.0 |
| 10 | 81.6 | 66.7 | 0 | 33.3 |
| 11 | 68.0 | 80.0 | 20.0 | 0 |
| 12 | 68.0 | 80.0 | 20.0 | 0 |
| 13 | 125.0 | 78.2 | 0 | 21.8 |
| 14 | 68.0 | 80.0 | 20.0 | 0 |
| 15 | 81.6 | 66.7 | 0 | 33.3 |
| 16 | 68.0 | 60.0 | 0 | 40.0 |
| 17 | 54.4 | 75.0 | 25.0 | 0 |
| 18 | 81.0 | 83.0 | 17.0 | 0 |
| 19 | 85.0 | 84.0 | 16.0 | 0 |
| 20 | 75.0 | 82.0 | 18.0 | 0 |

*The percentages reflected in this table assume that 100% of the polyvinyl alcohol fibers were washed out of the web in the manner described above.

Various properties of several of the samples were then tested. The results are shown below in Table 3.

TABLE 3

Physical Properties of Samples

| Sample | Basis Weight (gsm) | Caliper (cm) | Bulk ($cm^3/g$) | Absorption Capacity (%) $H_2O$ | Absorption Capacity (%) Light Machine Oil | Taber Abrasion (cycles) |
|---|---|---|---|---|---|---|
| 1 | 64 | 0.084 | 13.1 | 928 | 805 | 115 |
| 11 | 64 | 0.086 | 13.4 | 801 | 709 | 78 |
| 14 | 58 | 0.094 | 16.2 | 1061 | 1123 | 49 |
| 17 | 53 | 0.089 | 16.8 | 936 | 996 | 40 |
| 18 | 81 | 0.046 | 5.7 | 455 | 320 | 58 |
| 19 | 85 | 0.046 | 5.4 | 408 | 299 | 85 |
| 20 | 75 | 0.046 | 6.1 | 481 | 380 | 61 |

As indicated, various properties of the samples improved with an increased concentration of staple fibers. For example, the bulk of the fabric increased with an increased concentration of polyester staple fibers. Likewise, both water and oil capacity increased with an increase in the total content of staple fibers.

Figure 2:
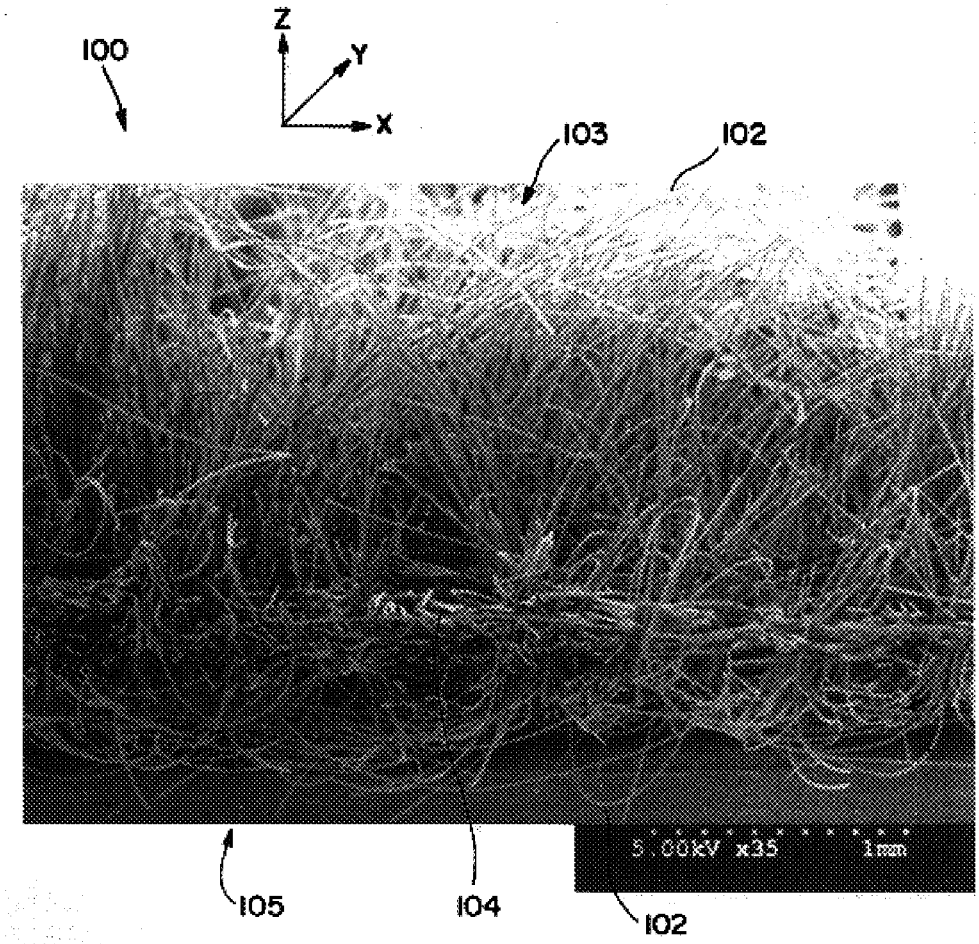
FIG. 2 is a cross-sectional, SEM photograph (5.00 kV,× 35) of a sample formed in Example 1.
Figure 3:
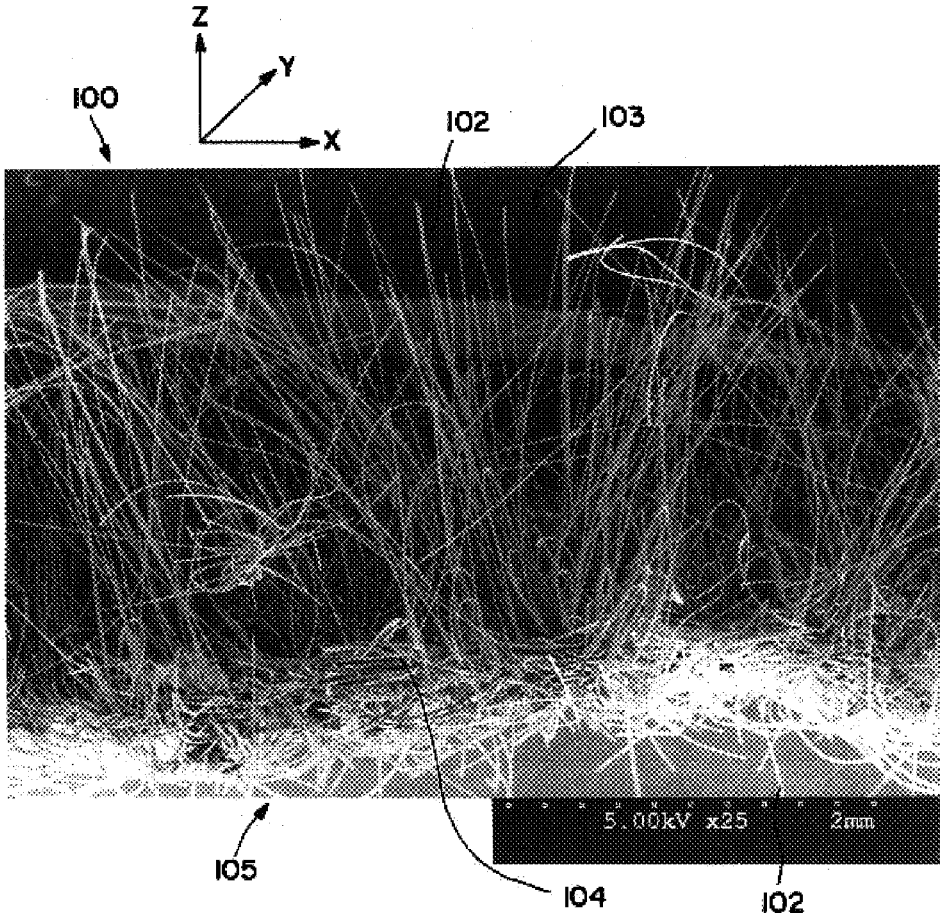
FIG. 3 is another cross-sectional, SEM photograph (5.00 kV,×25) of the sample shown in FIG. 2.

In addition, SEM photographs of Sample 14 are also shown in FIGS. 2 and 3. As shown, the fabric 100 has a surface 103 and a surface 105. The surface 103 contains a preponderance of staple fibers 102 protruding therefrom. Likewise, the surface 105 contains a preponderance of spunbond fibers 104, but also contains some staple fibers 102. Specifically, either the ends or a bent portion of the staple fibers 102 protrude from the surface 105. Regardless of the manner in which they protrude, the staple fibers 102 may provide enhanced softness and handfeel to each surface 103 and 105. Further, the staple fibers 102 are primarily oriented in the −z direction, while the spunbond fibers 104 are primarily oriented in the −x and −y directions.

EXAMPLE 2

The ability to form a composite fabric in accordance with the present invention was demonstrated.

Seven (7) different samples were formed from synthetic staple fibers having an average fiber length of 3.175 millimeters (lyocel and/or polyester) and optionally pulp fibers using a high consistency wet-lay papermaking machine as is well known in the art. The lyocel fibers had a denier per filament of 1.5, and were obtained from Engineered Fibers Technologies, Inc. of Shelton, Conn. under the name "Tencel." Two types of polyester fibers were utilized. The first type was monocomponent polyester fibers (denier of 1.5) obtained from Kosa under the name "Type 103." The second type was bicomponent polyester fibers (denier of 3) obtained from Kosa under the name "Type 105." In addition, the pulp fibers contained 50 wt. % northern softwood kraft fibers and 50 wt. % southern softwood kraft fibers. The resulting wet-laid staple fiber webs had a basis weight ranging from about 30 to about 90 grams per square meter.

The content of the staple fiber webs used to form Samples 21–27 is set forth below in Table 4.

TABLE 4

Staple Fiber Content of Samples 21–27

| Sample | Basis Wt. (g/m$^2$) | % Pulp | % Lyocel | % Polyester (Type 103) | % Polyester (Type 104) |
|---|---|---|---|---|---|
| 21 | 56.1 | 60.0 | 0 | 0 | 40.0 |
| 22 | 56.1 | 60.0 | 0 | 40.0 | 0 |
| 23 | 78.1 | 50.0 | 0 | 50.0 | 0 |
| 24 | 42.1 | 25.0 | 0 | 75.0 | 0 |
| 25 | 56.1 | 0 | 60.0 | 40.0 | 0 |
| 26 | 87.9 | 0 | 48.3 | 32.2 | 19.5 |
| 27 | 31.1 | 70.0 | 0 | 30.0 | 0 |

Each staple fiber web was then entangled with a polypropylene spunbond web (basis weight of 11.9 or 27.2 grams per square meter) in accordance with U.S. Pat. No. 5,204,703 to Everhart, et al. Specifically, the staple fiber web was deposited onto an Albany 14FT forming wire available from Albany International, and hydraulically entangled with a spunbond web at with entangling pressures ramped from 300 to 1800 pounds per square inch using several consecutive manifolds. The water used during the entangling process was at a temperature of 130 to 180° F., and thus dissolved the polyvinyl alcohol fibers and removed them from the fabric. The entangled fabric was then non-compressively dried for 1 minute with a through-air dryer (air at a temperature of 280° F.) so that the fabric reached a maximum temperature of up to 200° F. The resulting fabric samples had a basis weight ranging from about 50 to 115 grams per square meter, and contained varying percentages of the spunbond web and the staple fibers. The basis weight and total fiber content of Samples 21–27 are set forth below in Table 5.

TABLE 5

Basis Weight and Total Fiber Content of Samples 21–27

| Sample | Basis Weight (gsm) | Staple Fibers (wt. %) | 11.9 gsm Spunbond Web (wt. %) | 27.2 gsm Spunbond Web (wt. %) |
|---|---|---|---|---|
| 21 | 68 | 82.5 | 17.5 | 0 |
| 22 | 68 | 82.5 | 17.5 | 0 |
| 23 | 100 | 98.1 | 11.9 | 0 |
| 24 | 54 | 88.0 | 22.0 | 0 |
| 25 | 68 | 82.5 | 17.5 | 0 |
| 26 | 115 | 76.3 | 0 | 23.7 |
| 27 | 54 | 49.6 | 0 | 50.4 |

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method for forming a fabric, said method comprising hydraulically entangling staple fibers with a nonwoven web formed from continuous filaments to form a composite material, said staple fibers having an average fiber length of from about 0.3 to about 25 millimeters, wherein at least a portion of said staple fibers are synthetic, said composite material defining a first surface and a second surface, said first surface containing a preponderance of said staple fibers and said second surface containing a preponderance of said continuous filaments, wherein at least a portion of said staple fibers also protrude from said second surface, and wherein the composite material has a bulk of about 10 cm$^3$/g to about 50 cm$^3$/g.

2. A method as defined in claim 1, wherein said staple fibers have an average fiber length of from about 0.5 to about 10 millimeters.

3. A method as defined in claim 1, wherein said staple fibers have an average fiber length of from about 3 to about 8 millimeters.

4. A method as defined in claim 1, wherein said staple fibers have a denier per filament of less than about 6.

5. A method as defined in claim 1, wherein said staple fibers have a denier per filament of less than about 3.

6. A method as defined in claim 1, wherein at least about 50 wt. % of said staple fibers are synthetic.

7. A method as defined in claim 1, wherein at least about 70 wt. % of said staple fibers are synthetic.

8. A method as defined in claim 1, wherein at least about 90 wt. % of said staple fibers are synthetic.

9. A method as defined in claim 1, wherein said synthetic staple fibers are formed from one or more polymers selected form the group consisting of polyvinyl alcohol, rayon, polyester, polyvinyl acetate, nylon, and polyolefins.

10. A method as defined in claim 1, wherein said staple fibers further include cellulosic fibers.

11. A method as defined in claim 10, wherein said cellulosic fibers comprise less than about 50 wt. % of said staple fibers.

12. A method as defined in claim 10, wherein said cellulosic fibers comprise less than about 30 wt. % of said staple fibers.

13. A method as defined in claim 10, wherein said cellulosic fibers comprise less than about 10 wt. % of said staple fibers.

14. A method as defined in claim 1, further comprising forming said staple fibers into a web prior to hydraulically entangling said staple fibers with said nonwoven web formed from continuous filaments.

15. A method as defined in claim 1, wherein said nonwoven web formed from continuous filaments is a spunbond web.

16. A method as defined in claim 1, wherein said staple fibers comprise greater than about 40 wt. % of said composite material.

17. A method as defined in claim 1, wherein said staple fibers comprise from about 60 wt. % to about 90 wt. % of said composite material.

18. A method as defined in claim 1, wherein said staple fibers are hydraulically entangled with said nonwoven web at a fluid pressure of from about 100 to about 4000 psig.

19. A method as defined in claim 1, wherein said staple fibers are hydraulically entangled with said nonwoven web at a fluid pressure of from about 200 to about 3500 psig.

20. A method as defined in claim 1, wherein said staple fibers are hydraulically entangled with said nonwoven web at a fluid pressure of from about 300 to about 2400 psig.

21. A method as defined in claim 1, further comprising non-compressively drying said composite material.

22. A method as defined in claim 21, wherein said wherein said composite material is through-dried.

23. A method as defined in claim 1, wherein said composite material has a bulk of from about 10 to about 40 $cm^3/g$.

24. A method as defined in claim 1, wherein a majority of the synthetic staple fibers are primarily oriented in the z-direction of the composite material.

25. A method for forming a fabric, said method comprising:

hydraulically entangling staple fibers with a spunbond web formed from continuous filaments to form a composite material, said staple fibers having an average fiber length of from about 3 to about 8 millimeters, wherein at least about 50 wt. % of said staple fibers are synthetic; and wherein said composite material defines a first surface and a second surface, wherein the bulk of said composite material is from about 10 to about 50 $cm^3/g$.

26. A method as defined in claim 25, wherein said staple fibers have a denier per filament of less than about 6.

27. A method as defined in claim 25, further comprising through-drying said composite material.

28. A method as defined in claim 25, wherein said synthetic staple fibers are formed from one or more polymers selected form the group consisting of polyvinyl alcohol, rayon, polyester, polyvinyl acetate, nylon, and polyolefins.

29. A method as defined in claim 25, wherein said staple fibers comprise greater than about 40 wt. % of said composite material.

30. A method as defined in claim 25, wherein said staple fibers comprise from about 60 wt. % to about 90 wt. % of said composite material.

31. A method as defined in claim 25, wherein said staple fibers are hydraulically entangled with said nonwoven web at a fluid pressure of from about300 to about 2400 psig.

32. A method as defined in claim 27, wherein said composite material has a bulk of from about 10 to about 40 $cm^3/g$.

33. A method as defined in claim 25, wherein said composite material defines a first surface and a second surface, said first surface containing a preponderance of said staple fibers and said second surface containing a preponderance of said continuous filaments, wherein at least a portion of said staple fibers also protrude from said second surface, and wherein a majority of the synthetic staple fibers are primarily oriented in the z-direction of the composite material.

34. A method for forming a fabric, said method comprising hydraulically entangling staple fibers with a nonwoven web formed from continuous filaments to form a composite material, said staple fibers having an average fiber length of from about 0.3 to about 25 millimeters, wherein at least a portion of said staple fibers are synthetic, said composite material defining a first surface and a second surface, said first surface containing a preponderance of said staple fibers and said second surface containing a preponderance of said continuous filaments, wherein at least a portion of said staple fibers also protrude from said second surface, and wherein a majority of the synthetic staple fibers are primarily oriented in the z-direction of the composite material.

35. A method as in claim 34, wherein the composite fabric has a bulk of from about 7 $cm^3/g$ to about 50 $cm^3/g$.

36. A method as in claim 34, wherein the composite fabric has a bulk of from about 10 $cm^3/g$ to about 50 $cm^3/g$.

37. A method as in claim 34, wherein the majority of the synthetic staple fibers are oriented in a direction that is substantially perpendicular to the second surface of the composite fabric.

* * * * *

UNITED STATES PATENT AND TRADEMARK OFFICE

CERTIFICATE OF CORRECTION

PATENT NO. : 7,194,788 B2
APPLICATION NO. : 10/744606
DATED : March 27, 2007
INVENTOR(S) : Clark et al.

It is certified that error appears in the above-identified patent and that said Letters Patent is hereby corrected as shown below:

Column 18, line 38 (Claim 9) "form the group consisting" should read --from the group consisting--

Signed and Sealed this

Twenty-eighth Day of August, 2007

JON W. DUDAS
*Director of the United States Patent and Trademark Office*